United States Patent [19]

Bowman et al.

[11] 4,139,097

[45] Feb. 13, 1979

[54] STACKABLE CONTAINER TRAY FOR STORING AND DISPLAYING FLAT OBJECTS

[75] Inventors: Robert G. Bowman, Darien; John G. Russell, Fairfield, both of Conn.

[73] Assignee: The C. R. Gibson Company, Norwalk, Conn.

[21] Appl. No.: 792,979

[22] Filed: May 2, 1977

[51] Int. Cl.[2] ..... B65D 85/00

[52] U.S. Cl. ..... 206/425; 206/449; 206/511; 206/560

[58] Field of Search ..... 206/560, 449, 425, 511, 206/555; 40/104.12, 152, 10 R, 16 R

[56] References Cited

U.S. PATENT DOCUMENTS

| | | | |
|---|---|---|---|
| 1,386,717 | 8/1921 | Buckett et al. | 206/449 |
| 1,430,207 | 9/1922 | Woodhouse | 206/449 |
| 1,567,133 | 12/1925 | Goldstine | 206/449 |
| 1,719,358 | 7/1929 | Campbell | 206/425 |
| 2,726,795 | 12/1955 | Billock et al. | 220/352 |
| 2,988,412 | 6/1961 | Vannice | 206/511 |
| 4,004,690 | 1/1977 | Giarritta | 206/425 |

FOREIGN PATENT DOCUMENTS

| | | | |
|---|---|---|---|
| 218362 | 11/1958 | Australia | 206/511 |
| 161939 | 12/1921 | United Kingdom | 206/449 |

*Primary Examiner*—William Price

*Assistant Examiner*—Joseph Man-Fu Moy

*Attorney, Agent, or Firm*—Albert C. Johnston; Ronald A. Clayton

[57] ABSTRACT

A semi-transparent, tray-like container having a flat bottom and substantially vertical side and end walls defining a storage space has flange-like projections on each side wall inner surface in proximity to but spaced from the bottom to define, with the bottom, a retaining channel which slidably receives a removable panel assembly containing a plurality of hinged overlapping transparent envelopes which can be flipped like pages to display flat objects such as photography, stamps, recipes and the like contained therein. The retaining channel holds the panel assembly securely in place with little or no movement even when the envelope pages are turned with the result that the flat objects remain organized and in place in the container for safe storage and convenient display. The container bottom is constructed with supporting legs which may project into the opening of a like container for stacked alignment therewith to provide a system of a plurality of stacked tray-like containers. Downwardly projecting bosses on the container bottom contact the top edge of the walls of an adjacent container of the stack to provide spacing between containers. A semi-transparent lid having edges which overhang the sides of the container and a depending lip which fits inside the container opening may be placed on the container.

5 Claims, 9 Drawing Figures

Fig. 5.
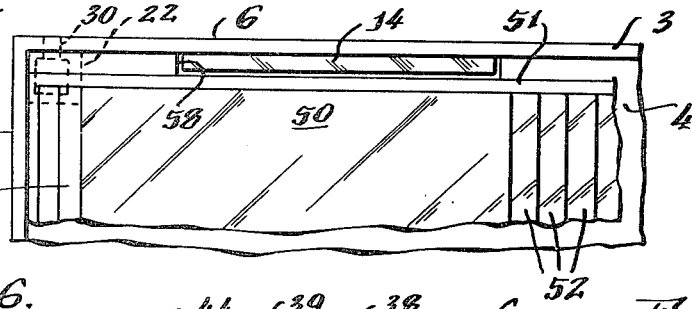
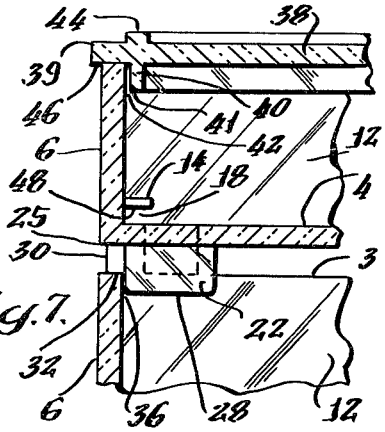
Fig. 7.
Fig. 6.
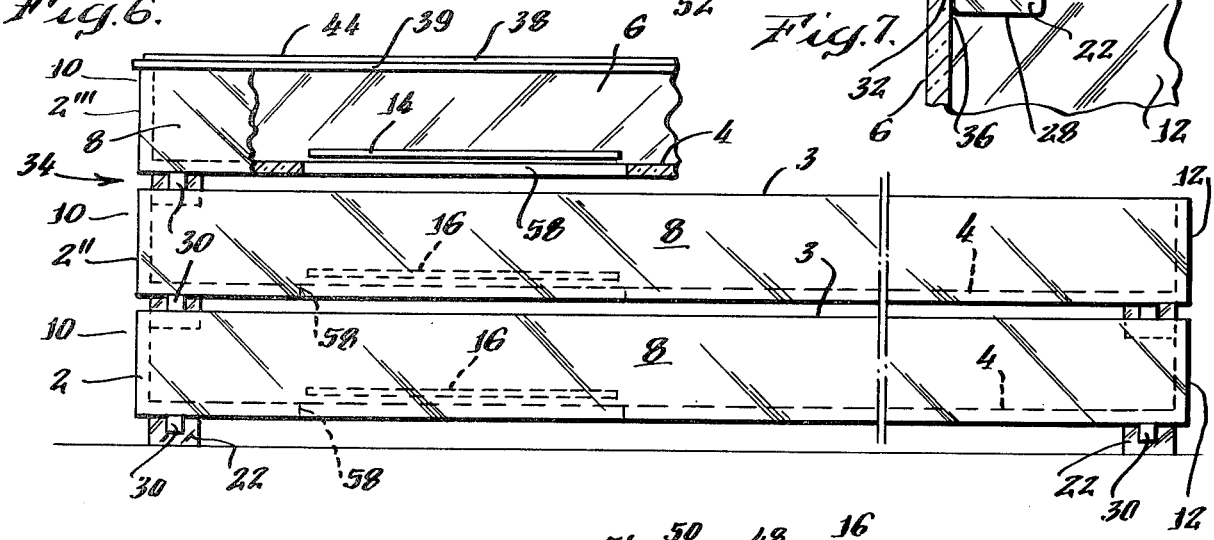
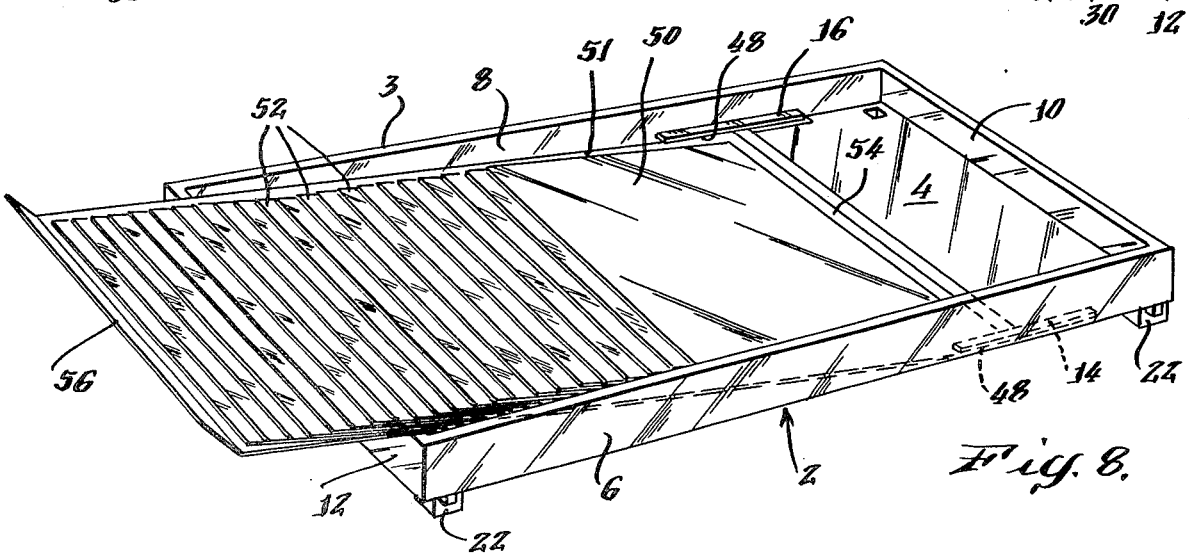
Fig. 8.
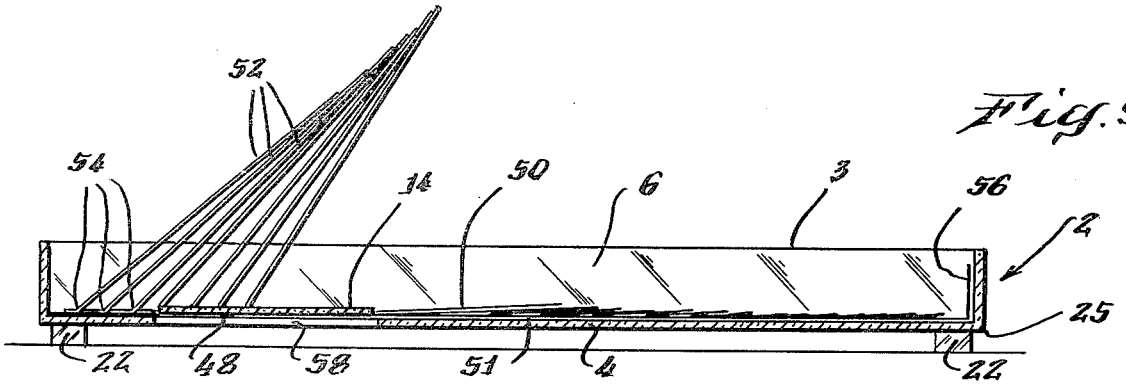
Fig. 9.

STACKABLE CONTAINER TRAY FOR STORING AND DISPLAYING FLAT OBJECTS

This invention relates to containers for storing and displaying items and, more particularly, to semi-transparent, tray-like containers for receiving a panel of hinged overlapping envelopes for holding flat objects such as photographs, recipes, stamps and the like for viewing. The tray-like container is stackable with similar containers to form a system for storing and displaying the flat objects in an attractive and convenient manner.

Many people desire to display photographs or hobby items such as stamp collections, recipe collections, butterfly collections, and the like, to those interested in viewing them. However, at the same time it is usually desired to maintain such items in a manner which will prevent them from being lost or damaged through improper storage or by mishandling. Frequently this is done by mounting flat objects, such as photographs or stamps, in an album, either directly on a page or within transparent envelopes which are hinged in overlapping fashion to a panel so that their contents may be easily viewed by flipping the envelopes as in turning the pages of a book.

There are certain disadvantages associated with the type of storage described above. For example, photo and stamp albums are frequently merely placed in closets or drawers and forgotten at times when it would be enjoyable to view them. Moreover, often such albums are insufficiently attractive to be left in readily accessible places which are constantly open to view, such as on shelves or tables in a room. Also, even albums which have hard covers do not provide as safe a storage for such objects as would, for example, a rigid container with a cover. However, the drawbacks of a covered rigid container include not only difficulty of display of its contents, but also the fact that the contents are generally loosely stored therein in an unorganized fashion. In addition, frequently such containers which are used for the storage of items such as photographs, stamps or recipes lack the pleasing appearance that would encourage one to keep them on open view in a room.

SUMMARY OF THE INVENTION

The present invention provides a container and a system of containers for storing and displaying flat objects such as photographs, stamps, recipes, and the like which overcomes the above mentioned disadvantages. This is achieved, according to the present invention, through the provision of a semi-transparent, tray-like container having a flat bottom and substantially vertical side and end walls defining a storage space, the side walls of which have flange-like projections in proximity to but spaced from the bottom to define, with the bottom, a retaining channel.

The retaining channel slidably receives a removable panel assembly containing a plurality of hinged overlapping transparent envelopes which can be flipped like pages to display their contents. The retaining channel holds the panel assembly securely in place with little or no movement even when the envelope pages are turned so that the objects therein remain organized and in place. At the same time, the panel assembly is slidably removable from the retaining channel so that it may be changed or replaced by another containing different objects for display.

The container may advantageously be constructed to be stackable with like containers to provide a system of stacked tray-like containers for storing and displaying of flat objects. Each container is advantageously provided with legs which fit inside the open top of a like container tray and is provided with bosses on its bottom which maintain it spaced apart from the container into which it is stacked. Thus, gripping and separation of the container from one another to enable quick and convenient selection of a desired container tray from a stack for viewing its contents is facilitated. The container, either singly or as the top container of a stacked system, is provided with a lid which is semi-transparent, as are the container walls, to enable easy identification of the container contents.

Accordingly, a feature of this invention is the provision of a tray-like container having internal retaining means for securely holding down a removable panel assembly of hinged overlapping envelopes for the storage and display of flat objects.

Another feature of this invention is the provision of a system of stacked tray-like containers each of which is provided with internal retaining means for securely retaining a panel assembly of hinged overlapping envelopes containing flat objects for storage and viewing display.

A further feature of this invention is the provision of a semi-transparent tray-like container for securely holding a removable panel assembly of a plurality of hinged overlapping transparent envelopes which can be pivotally flipped like pages to display contents such as photographs, stamps, recipes and similar flat objects for viewing.

The foregoing and additional features, objects and advantages of the present invention will be further apparent from the following description of preferred embodiments thereof taken in conjunction with the accompanying drawings.

BRIEF DESCRIPTION OF THE DRAWINGS

FIG. 5 is a top view of a portion of the tray-like container interior showing the projection forming the retaining channel holding the panel assembly, in greater detail;

FIG. 6 is a side view, partly in section, of a system of stacked tray-like containers of the type shown in FIG. 3, showing the retaining channel in greater detail;

FIG. 7 is a sectional view, in enlarged detail, showing two tray-like containers and the manner of stacking interengagement therebetween and the lid fit thereon;

FIG. 8 is a top perspective view of a tray-like container showing the removable panel assembly of hinged overlapping envelopes partially inserted therein; and FIG. 9 is a side view, partly in section, showing the panel assembly of hinged overlapping envelopes retained securely in the tray-like container with the envelopes being pivoted to a condition permitting viewing of the contents of one of them.

DESCRIPTION OF THE PREFERRED EMBODIMENTS

Figure 1:
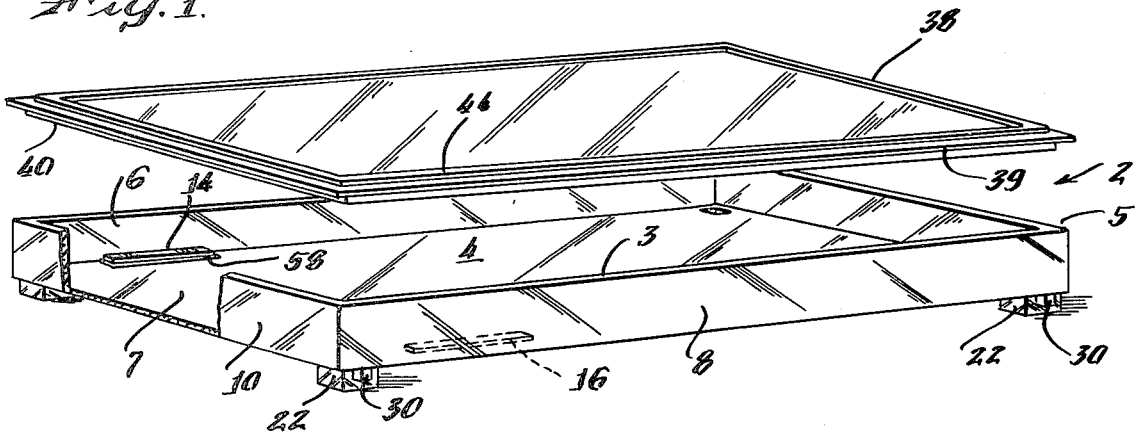
FIG. 1 is a top perspective view of a semi-transparent tray-like container and its lid according to a preferred embodiment of this invention.
Figure 2:
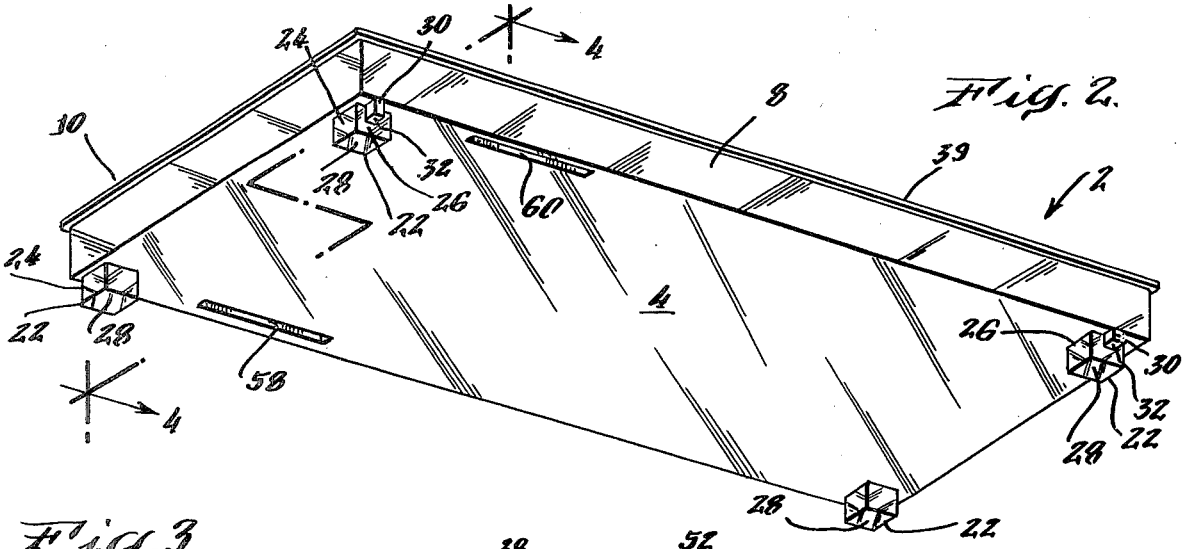
FIG. 2 is a bottom perspective view of the tray-like container shown in FIG. 1.
Figure 4:
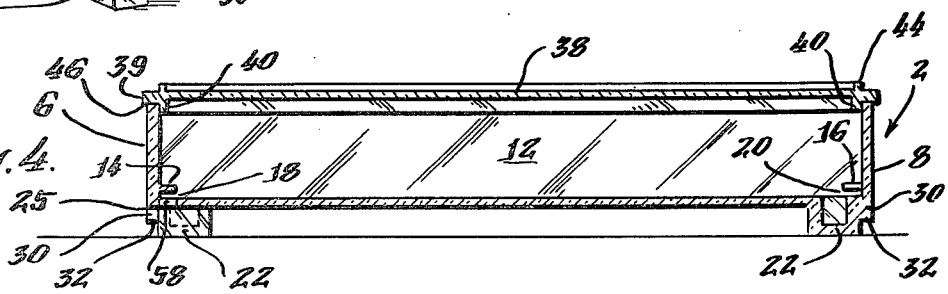
FIG. 4 is a sectional view through the tray-like container and its lid taken along the line 4—4 of FIG. 2.

Referring to FIGS. 1, 2 and 4, there is shown a tray-like container 2 having a horizontal flat bottom 4 joined to two vertical elongated side walls 6 and 8 and two vertical end walls 10 and 12. The side and end walls together form a top rim 3 which defines an opening indicated generally at 5 and with the bottom define a storage space indicated generally at 7.

A pair of flange-like projections 14 and 16 are located along a portion of the inner surface of the side walls 6 and 8, respectively. The flange-like projections 14 and 16 project inwardly into the container space 7 and are in proximity to but spaced from the bottom 4 to define, with the bottom, a pair of retaining channels 18 and 20, as shown best in FIG. 4. The purpose of the retaining channels 18 and 20, as will be explained in greater detail hereinafter, is to slidably receive a removable flat panel or sheet which is inserted between the bottom 4 and the flange-like projections 14 and 16 to be held firmly therebetween in slot-like engagement.

Each corner of the bottom 4 of the container 2 has a supporting leg-like projection 22 depending downwardly from the bottom, as shown best in FIG. 2. Each leg 22 has at least one side 24 which is substantially parallel to the inner surface of the container end walls 10 and 12 as well as one side 26 which is substantially parallel to the inner surface of the container side walls 6 and 8. The sides 24 and 26 are both disposed inwardly from the outer peripheral edge 25 of the bottom 4 a distance sufficient to provide a slight clearance between the leg side walls 24 and 26 and the inner surface of the end walls 10 and 12 and side walls 8 and 10 to permit insertion of the legs of one container 2 into opening 5 defined by the top rim of the side and end walls of a like container for stackable alignment therewith, as explained below in greater detail in reference to FIG. 3.

Each leg 22, in the embodiment shown, has a flat bottom portion 28 to facilitate stable placement on a flat surface such as a shelf, table top and the like. Located on the exterior of each side 26 of each leg 22 is a boss 30 which also projects downwardly from the container bottom 4 but for a distance less than that of the leg 22 while also extending fully to the edge 25 of the bottom 4. Thus, when the container 2 is placed upon a like container for stackable alignment the legs 22 project into the opening 5 of the other container whereas the bosses 30 do not project into the opening but rather contact the top rim 3 formed by the end and side walls to provide a spacing between the aligned stacked containers.

Figure 3:
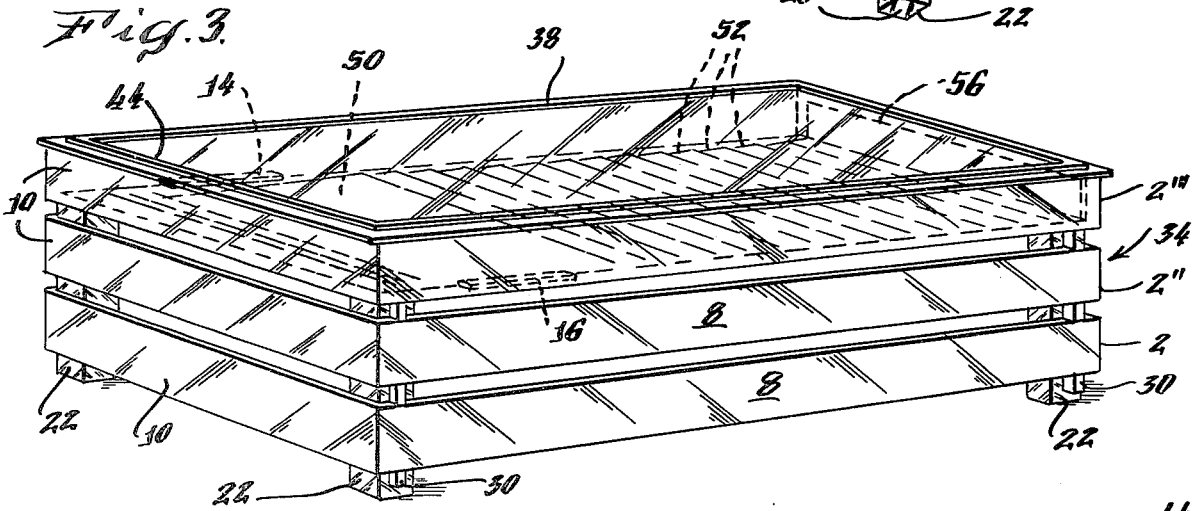
FIG. 3 is a top perspective view of a system formed by an assembly of stacked tray-like containers of the type shown in FIG. 1 showing contents visible therein.

The stacking alignment of a plurality of containers 2 is shown in FIGS. 3 and 6 showing a stack collectively identified at 34. The bottommost container 2' rests flat on a surface through its legs 22 while the legs 22 of the middle container 2'' project into the opening formed by the end and side walls of the container 2' for stackable alignment therewith. The alignment is maintained stable and firm and free from appreciable lateral movement by virtue of the fact that the sides 24 and 26 of the legs 22 are spaced but a small distance 36 from the inner sides of the container side and end walls as shown in FIG. 7 illustrating the clearance space 36 between the side wall 26 of the leg 22 and the inner surface of the side wall 6 of the container 2 in slightly exaggerated form. This spacing 36 and a similar spacing between the sides 24 of the legs 22 and the inner surfaces of the end walls is such as to permit good stackable alignment with a minimum of lateral movement while still retaining the ability to easily separate one container from the other.

As shown in FIGS. 3 and 6, each container is kept spaced from the other by means of the bosses 30 in such a way so that each container can be conveniently grasped by the fingers and separated from the other container into which it is stacked without the problem of grasping more than one container as could be the case with identically dimensioned containers which are not maintained spaced apart from one another in the stacked condition.

In order to further protect the contents of the container 2, as well as provide a pleasing appearance, a lid 38, FIGS. 1, 3 and 4, may be provided for the container 2 or for the topmost container 2''' of a stack of containers 34. Projecting from the bottom surface of the lid 38 is a continuous lip 40, the exterior peripheral surface of which is substantially parallel to and aligned with the interior surfaces of the side and end walls of the container 2, although spaced apart therefrom a small distance 42, to provide firm-fitting engagement when placed on the container.

The upper surface of the lid 38 is also provided with a continuous flange-like projection 44 which can provide additional ridigity and strength to the lid 38 as well as a pleasing appearance through the avoidance of sink marks which may be occasioned by molding the lip 40. The lid 38 is dimensioned such that its edge 39 extends a slight distance 46 beyond the exterior surfaces of the side walls and end walls of the container 2, FIGS. 4 and 7, in order to provide an overhang facilitating gripping of the lid for removal when desiring to view or remove the contents of the container 2.

The unique advantages of the flange-like projections 14 and 16 forming the retaining channels 18 and 20 with the container bottom 4 can be best understood by reference to FIGS. 5, 8 and 9 showing the cooperation between these parts and a panel assembly 50 inserted therein. The panel assembly 50 contains a plurality of transparent envelopes 52 each of which is hinged to a flat support panel 51 at a hinge 54 and overlaps another envelope. The envelopes 52, which may contain photographs, stamps or similar flat objects for storage and display, can be pivoted on their hinges 54 as shown in FIG. 9 to expose both sides of an envelope 52 as well as exposing the envelope beneath an overlapping envelope.

When pivoting or flipping the envelopes for viewing or insertion of objects, an upward force is necessarily exerted on the assembly 52 and on the support panel 51 which normally urges or pulls the entire panel assembly 50 upward. However, in the container 2 shown, the projections 14 and 16 securely hold down the edges of the support panel 51 exteriorly of the lapped envelopes 52 to keep the panel assembly 50 firmly in place. Nevertheless, the entire panel assembly 50 may be easily removed from the container 2 by grasping the panel support panel tab end 56 and sliding the support panel 51 out from underneath the projections 14 and 16, as shown best in FIG. 8.

The tray-like container 2 and its lid 38 are advantageously fabricated from a semi-transparent general purpose plastic material such as amber-smoke colored polystyrene so that the contents of a single container or a stack of them may be at least partially viewed through the lid and walls, as seen in FIG. 3. In this way, the contents of the container may be immediately known and, when stacked, a desired container can be readily selected from the stack. This feature, together with the spacing of the containers from one another when stacked and the overhanging edge of the lid, both of which facilitate grasping, make selection and viewing of the flat objects contained within the envelopes in the containers convenient and enjoyable.

The container 2 and the lid 38 can be fabricated by molding, such as by injection molding, and this can be facilitated by providing slots 58 and 60 in the bottom 4 to enable molding of the projections 14 and 16, respectively, with a reduced number of molding steps and mold parts due to the presence of reentrant portions. Similarly, molding may be facilitated by forming the legs 22 integral with the container bottom and side and end walls with an opening 62 in the leg 22, as shown in FIG. 5.

Due to the stability of the stacking interengagement between like containers, a large number of tray-like containers can be stacked together. For variety, the panel assembly can be easily removed from a container and replaced with another for storage and display. The individual containers as well as the stack system provide attractive as well as highly efficient storage and display of flat objects and can find ready use in convenient and visible locations in both homes and businesses.

We claim:

1. A system for storing and displaying for convenient viewing substantially flat objects such as photographs, recipes, stamps, or the like, held in envelopes of storage assemblies each of which includes a multiplicity of envelopes hinged to a substantially flat rectangular supporting panel so as to lie in overlapping relation upon the panel yet leaving opposite side edge portions of the panel unobstructed, said system comprising a plurality of containers stackable one upon another, each of said containers consisting essentially of a unitary, shallow tray-like structure formed by a substantially rectangular bottom wall bordered by opposite upright side walls and opposite upright end walls formed integrally therewith, said walls defining an open-top shallow storage space adapted to receive and encompass the panel and envelopes of one of said assemblies, said side walls having rigid flanges formed integrally therewith and protruding inwardly therefrom over said bottom wall in spaced relation thereto at a location toward one end only of said storage space, said flanges forming channels into which said edge portions of a said panel are slidable and by which the panel is held in place as a said storage assembly is placed into the container, said flanges being sufficiently narrow that the envelopes on a said panel held in said channels are swingable upwardly free of said flanges for selectively viewing individual envelopes on the panel.

2. A system according to claim 1, further comprising a substantially rigid lid fittable onto the open top of any one of said containers, said lid comprising a semi-transparent unitary body formed to cover said storage space and extend over the upper edges of said side and end walls of the one container and a lip depending from said body inwardly of its edges so as to fit into the container inside said upper edges.

3. A system according to claim 1, said walls of each of said containers being semi-transparent so as to enable at least partial viewing of the container contents yet shield them from deleterious light.

4. A system according to claim 1, each of said containers having supporting legs formed on and protruding downward from respective portions of its said bottom wall near the corners thereof, each of said legs having substantially flat upright sides forming a leg corner spaced inward from adjacent edges of said bottom wall so that said legs will nest into the corners formed by said side and end walls of any one of said containers.

5. A system according to claim 4, each of said containers also having on its bottom wall at a side of each of its said legs near an edge of the bottom wall an integral embossment positioned to engage against the upper edge of a said upright wall of any other of said containers so that, when the container is stacked upon another of said containers, its said embossments will hold its bottom wall spaced above the other container.

* * * * *